US005495965A

United States Patent [19]

Knickerbocker

[11] Patent Number: 5,495,965

[45] Date of Patent: Mar. 5, 1996

[54] DIP TUBE FOR HAND OPERATED DISPENSING DEVICE

[75] Inventor: Michael G. Knickerbocker, Crystal Lake, Ill.

[73] Assignee: Aptar Group, Inc., Cary, Ill.

[21] Appl. No.: 233,039

[22] Filed: Apr. 25, 1994

[51] Int. Cl.[6] ..... B67D 5/60

[52] U.S. Cl. ..... 222/464.1; 222/382

[58] Field of Search ..... 222/211, 382, 222/464, 464.1

[56] References Cited

U.S. PATENT DOCUMENTS

| | | | |
|---|---|---|---|
| 1,518,705 | 12/1924 | Raun . | |
| 1,963,056 | 6/1934 | Wilcox . | |
| 2,564,400 | 8/1951 | Hall | 222/464 |
| 2,770,068 | 11/1956 | Jakab . | |
| 3,301,438 | 1/1967 | Tillotson . | |
| 3,311,274 | 3/1967 | Green . | |
| 3,622,049 | 11/1971 | Thompson | 222/211 X |
| 3,674,179 | 7/1972 | Galloway | 222/464 X |
| 3,794,247 | 2/1974 | Corsette | 222/211 X |
| 4,887,743 | 12/1989 | Blake | 222/402.1 |
| 4,913,316 | 4/1990 | Richter | 222/464 X |
| 4,940,170 | 7/1990 | Popp-Ginsbach | 222/402.1 |
| 5,048,572 | 9/1991 | Levine . | |
| 5,054,966 | 10/1991 | Filippelli . | |

*Primary Examiner*—Kevin P. Shaver
*Attorney, Agent, or Firm*—Frijouf, Rust & Pyle

[57] ABSTRACT

An improved dip tube for a hand operated dispensing device is disclosed comprising a longitudinally extending dip tube having an outer surface and an inner surface for defining a wall thickness therebetween. A plurality of surface projections protrude from the outer surface of the dip tube and extend longitudinally along the dip tube. The plurality of surface projections are uniformly disposed about the dip tube for defining a plurality of recessed portions therebetween. The plurality of surface projections define major wall thickness portions for providing structural strength for the dip tube. The improved dip tube provides a conventional cross-section area of the internal channel with a reduced volume of material used in the construction of the improved dip tube.

17 Claims, 3 Drawing Sheets

DIP TUBE FOR HAND OPERATED DISPENSING DEVICE

BACKGROUND OF THE INVENTION

1. Field of the Invention

This invention relates to dispensing, and more particularly to an improved dip tube for a hand operated dispensing device comprising major wall thickness portions for providing structural strength for the dip tube and comprising minor wall thickness portions for reducing the volume of material used in the construction of the improved dip tube.

2. Background of the Invention

Hand operated dispensers may be classified into either aerosol dispensers or hand operated pump dispensers. In a standard aerosol dispenser, an aerosol product and a propellant is sealed within a container by a mounting cup. The mounting cup houses an aerosol valve having a dip tube for providing a fluid conduit between the aerosol valve and the bottom of the container. A valve button is secured to the aerosol valve by a valve stem.

When the valve button is depressed, the aerosol valve is opened and aerosol product passes from the bottom of the container through the dip tube and the aerosol valve for discharge from a terminal orifice in the valve button.

In a standard hand operated pump dispenser, a pump product is sealed within a container by a container cap. The container cap supports a hand operated pump commonly referred to as a finger pump. The hand operated pump communicates with a container dip tube for providing a fluid conduit between the hand operated pump and the bottom of the container.

When the hand operated pump is actuated, the pump draws product from the bottom of the container through the dip tube to be projected by the pump from a terminal orifice of the pump.

Some in the prior art have modified standard tubes or conduits in an attempt to achieve a variety of desirable results. U.S. Pat. No. 1,518,705 to Raun discloses a conductor comprising a pipe having a plurality of corrugations cast integral with the interior wall of the pipe.

U.S. Pat. No. 1,963,056 to Wilcox discloses an internally ribbed tube for increasing the resistance to longitudinal bending.

U.S. Pat. No. 2,770,068 to Jakab discloses a powder atomizer container having a discharge and diffuser nozzle comprising a tube with ribs.

U.S. Pat. No. 3,311,274 to Green discloses a valve housing and dip tube assembly having a longitudinal groove defined in an outer surface.

U.S. Pat. No. 3,301,438 to Tillotson discloses a dip tube having a substantially cylindrical wall with a thicker portion and a thinner portion extending along opposite sides for providing a curve to the dip tube.

U.S. Pat. No. 5,048,572 to Levine discloses a heat shrinkable tubing which provides cushioning and vibration damping particularly useful for hand held power driven equipment. The tubing is extruded with internal ridges running along its entire length, which when heat shrunk on a substrate provides air pockets for cushioning and vibration damping.

U.S. Pat. No. 5,054,966 to Filippelli discloses a pipe for the pneumatic transport of solid polymer particles having an internal diameter with constrictions along its length. The pipe can be used to transport polymer particles with the aid of a carrier gas.

Although hand operated dispensers are extremely economical due to superior design and manufacturing techniques, the manufacturers of hand operated dispensers continue to strive to further increase the efficiency of manufacture. One significant method of reducing the manufacturing cost of hand operated dispensers, is to reduce the volume of material required to manufacture the hand operated dispenser.

Therefore, it is an object of the present invention to provide an improved dip tube for a hand operated dispensing device having a reduced volume of material used in the construction of the improved dip tube.

Another object of this invention is to provide an improved dip tube for a hand operated dispensing device incorporating a plurality of surface projections protruding from a surface of the dip tube for providing structural strength for the dip tube.

Another object of this invention is to provide an improved dip tube for a hand operated dispensing device incorporating a plurality of recessed portions defining minor wall thickness for reducing the volume of material used in the construction of the dip tube.

Another object of this invention is to provide an improved dip tube for a hand operated dispensing device having substantially identical physical characteristics as the dip tubes of the prior art.

Another object of this invention is to provide an improved dip tube for a hand operated dispensing device having an internal channel of substantially identical cross-sectional area as the dip tubes of the prior art.

Another object of this invention is to provide an improved dip tube for a hand operated dispensing device that is suitable for use with existing aerosol valves and pumps.

Another object of this invention is to provide an improved dip tube for a hand operated dispensing device that may be secured to existing aerosol valves and existing pumps with conventional aerosol valve assembling equipment.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved dip tube for a hand operated dispensing device comprising a dispenser affixed to a container for dispensing a fluid within the container. The dispenser has a dip tube receiver for frictionally securing a dip tube thereto for extending into the fluid within the container. The improved dip tube comprises a dip tube including a longitudinally extending tube defined about a central longitudinal tube axis. The dip tube has an outer surface and an inner surface for defining a wall thickness therebetween. A plurality of surface projections protrude from the outer surface of the dip tube and extend longitudinally along the dip tube. The plurality of surface projections are uniformly radially disposed about the dip tube for defining a plurality of recessed portions therebetween. The plurality of surface projections define major wall thickness portions proximate each of the plurality of surface projections for providing structural strength for the dip tube. The plurality of recessed portions define minor wall thickness portions proximate each of the plurality of recessed portions for reducing the volume of material used in the construction of the improved dip tube. The dip tube is secured to the dip tube receiver of the dispenser for extending into the fluid within the container to provide an internal channel with a conventional cross-section area and with the improved dip tube having a reduced volume of material used in the construction of the improved dip tube.

In a more specific embodiment of the invention, the plurality of surface projections protrude radially from the outer surface away from the central longitudinal tube axis with the dip tube defining a substantially cylindrical inner surface.

The plurality of surface projections are uniformly radially interposed between the plurality of surface recessed portions and are uniformly radially disposed about the central longitudinal tube axis of the dip tube. Preferably, the plurality of surface projections comprises eight surface projections uniformly radially disposed about the central longitudinal tube axis of the dip tube.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
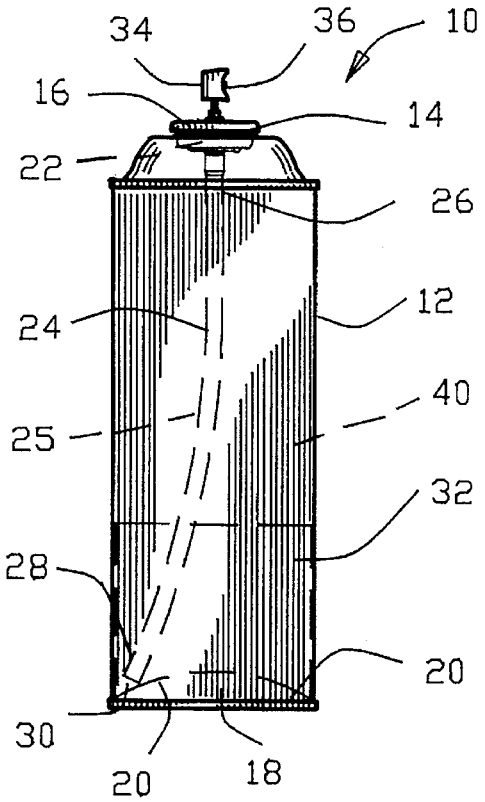
FIG. 1 is an elevational view of a dispensing device shown as an aerosol dispenser having a dip tube extending from the aerosol dispenser into a fluid within a container.

FIG. 1 is an elevational view of a first dispenser shown as an aerosol dispenser 10, comprising a container 12 having a peripheral rim 14 for receiving a valve mounting cup 16 with the valve mounting cup 16 being crimped to the container 12 in a conventional manner. The container 12 defines a bottom central region 18 and a bottom peripheral region 20 thereof.

The mounting cup 16 supports an aerosol valve 22 of conventional design, the operation of which should be well known to those skilled in the art. A dip tube 24 comprises an internal channel 25 extending between a proximal end 26 and a distal end 28 with the proximal end 26 of the dip tube 24 being connected to a dispenser body 29 of the aerosol valve 22. The distal end 28 of the dip tube 24 defines an input aperture 30 for communicating with the product 32 within the container 12. The aerosol valve 22 supports a valve actuator 34 having a terminal orifice 36.

The aerosol valve 22 is movable between a closed position and an open position. Upon a displacement of the valve actuator 34, the aerosol valve 22 is moved into the open position whereat a propellant 40 forces the product 32 into the input aperture 30 at the distal end 28 of the dip tube 24, through the aerosol valve 22 to be discharged from the terminal orifice 36.

Figure 2:
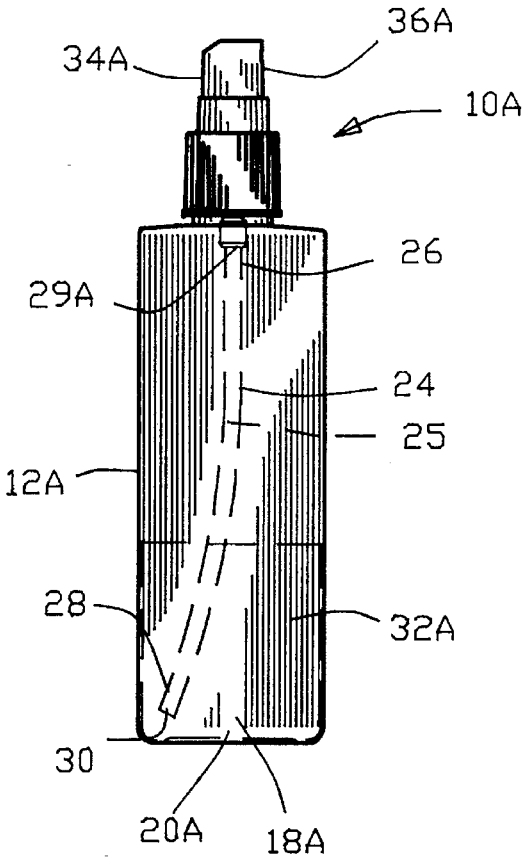
FIG. 2 PRIOR ART
FIG. 2 is an elevational view of a dispensing device shown as a pump having a dip tube extending from the pump into a fluid within a container.

FIG. 2 is an elevational view of a second dispenser shown as a pump dispenser 10A secured to a container 12A in a conventional manner. The container 12A defines a bottom central region 18A and a bottom peripheral region 20A thereof.

The pump dispenser 10A is of a conventional design, the operation of which should be well known to those skilled in the art. A dip tube 24 comprises an internal channel 25 extending between a proximal end 26 and a distal end 28 with the proximal end 26 of the dip tube 24 being connected to a dispenser body 29A of the pump dispenser 10A. The distal end 28 of the dip tube 24 defines an input aperture 30 for communicating with the product 32A within the container 12A. The pump dispenser 10A includes an actuator button 34A having a terminal orifice 36A.

The actuator button 34A is movable between an extended and a retracted position for drawing the product 32A into the input aperture 30 at the distal end 28 of the dip tube 24 to be discharged from the terminal orifice 36A.

Figure 3:
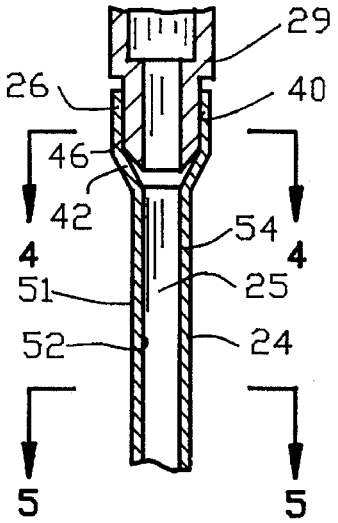
FIG. 3 PRIOR ART
FIG. 3 is an enlarged partial view of a prior art dip tube secured to a dispensing device.
Figure 4:
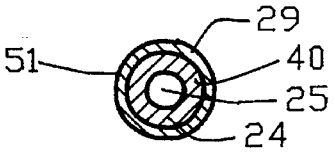
FIG. 4 PRIOR ART
FIG. 4 is a sectional view along line 4—4 in FIG. 3.
Figure 5:
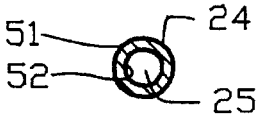
FIG. 5 is a sectional view along line 5—5 in FIG. 3.

FIG. 3 is an enlarged partial view of a conventional prior art dip tube 24 connected to the dispenser body 29 shown in FIG. 1 and representative of the dispenser body 29 of FIG. 1. FIG. 4 is a sectional view along line 4—4 in FIG. 3 whereas FIG. 5 is a sectional view along line 5—5 in FIG. 3.

The dispenser body 29 includes a dip tube receiver shown as a boss 40 for receiving the proximal end 26 of the dip tube 24 to provide a fluid tight seal therebetween. Typically, the boss 40 has an diameter selected for frictionally securing the dip tube 24 to the dispenser body 29. The boss 40 includes a taper 42 for facilitating insertion of the proximal end 26 of the dip tube 24 within the boss 40.

Figure 6:
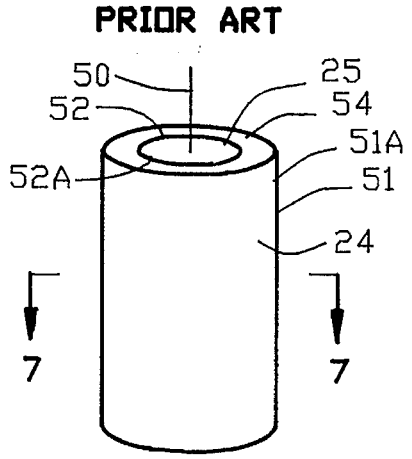
FIG. 6 is an enlarged isometric view of a prior art dip tube.
Figure 7:
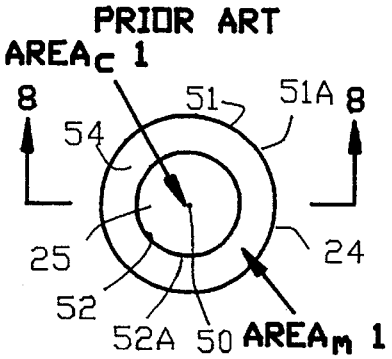
FIG. 7 is a sectional view along line 7—7 in FIG. 6.
Figure 8:
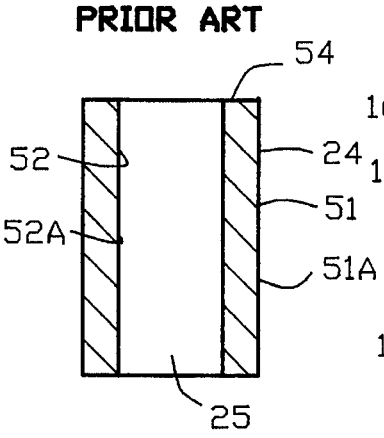
FIG. 8 is a sectional view along line 8—8 in FIG. 7.

FIG. 6 is an enlarged isometric view of the prior art dip tube 24. FIG. 7 is a sectional view along line 7—7 in FIG. 6 whereas FIG. 8 is a sectional view along line 8—8 in FIG. 7. The prior art dip tube 24 has central longitudinal tube axis 50 for defining an outer surface 51 of the dip tube 24 having a substantially circular outer diameter 51A. An inner surface 52 defines a substantially circular inner diameter 52A for providing a substantially uniform wall thickness 54. The substantially circular inner diameter 52A of the inner surface 52 defines the internal channel 25 to have a substantially circular cross-sectional area ($AREA_c$ 1). The substantially circular outer diameter 51A and the substantially circular inner diameter 52A provides a material cross-sectional area ($AREA_m$ 1).

The more popular dip tubes 24 used in the United States industry is made of a polyolefin material. Table I illustrates the parameters of the standard diameters of the internal channels 25 of the standard capillary dip tube 24 of the prior art.

TABLE I

| Standard Dip Tubes | | | |
|---|---|---|---|
| Inside Diameter | Outside Diameter | Channel Area | Wall Area |
| 0.122 | 0.182 | 0.01169 | 0.01433 |
| 0.147 | 0.196 | 0.01697 | 0.01320 |
| 0.165 | 0.203 | 0.02157 | 0.01102 |
| 0.288 | 0.338 | 0.06514 | 0.02459 |

Figure 9:
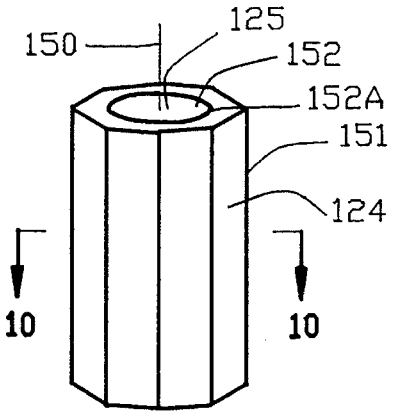
FIG. 9 is an enlarged isometric view of the improved dip tube of the present invention.
Figure 10:
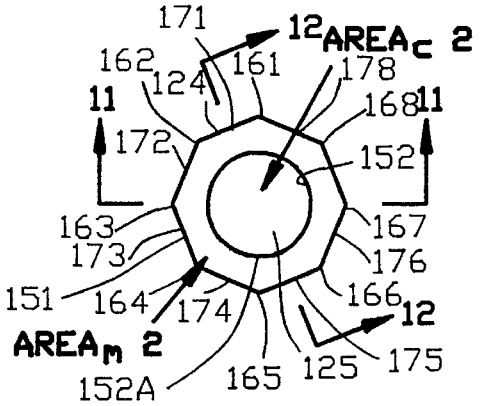
FIG. 10 is a sectional view along line 10—10 in FIG. 9.

FIG. 9 is an enlarged isometric view of the improved dip tube 124 of the present invention. FIG. 10 is a sectional view along line 10—10 in FIG. 9. The improved dip tube 124 has central longitudinal tube axis 150 for defining an outer surface 151. An inner surface 152 has a substantially circular inner diameter 152A for defining an internal channel 125.

The outer surface 151 of the improved dip tube 124 comprises a plurality of surface projections 161–168 protruding from the outer surface 151 of the dip tube 124 and extending longitudinally along the internal channel 125. The plurality of surface projections 161–168 are uniformly radially disposed about the dip tube 124 for defining a plurality of recessed portions 171–178 therebetween. The internal channel 125 defined by the inner surface 152 has a cross-sectional area ($AREA_c$ 2). The inner diameter 152A and the outer surface 151 provides a material cross-sectional area ($AREA_m$ 2).

Figure 11:
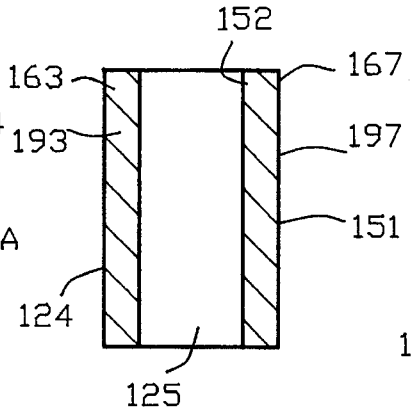
FIG. 11 is a sectional view along line 11—11 in FIG. 10.

FIG. 11 is a sectional view along line 11—11 in FIG. 10 illustrating the plurality of surface projections 161–168 defining major wall thickness portions 181–188 proximate each of the plurality of surface projections 161–168 for providing structural strength for the dip tube 124. The distance between opposed surface projections 161–168 define a first diameter.

Figure 12:
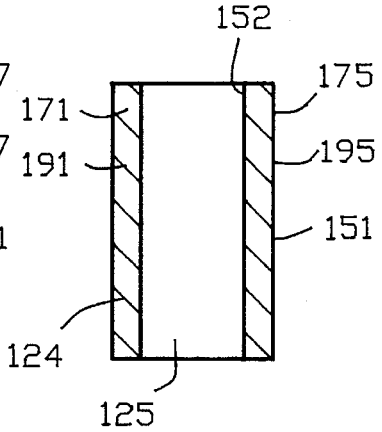
FIG. 12 is a sectional view along line 12—12 in FIG. 10.

FIG. 12 is a sectional view along line 12—12 in FIG. 10 illustrating the plurality of recessed portions 171–178 defining minor wall thickness portions 191–198 proximate each of the plurality of recessed portions 171–178 for reducing the volume of material used in the construction of the improved dip tube 124. The distance between opposed recessed portions 171–178 define a second diameter.

Figure 13:
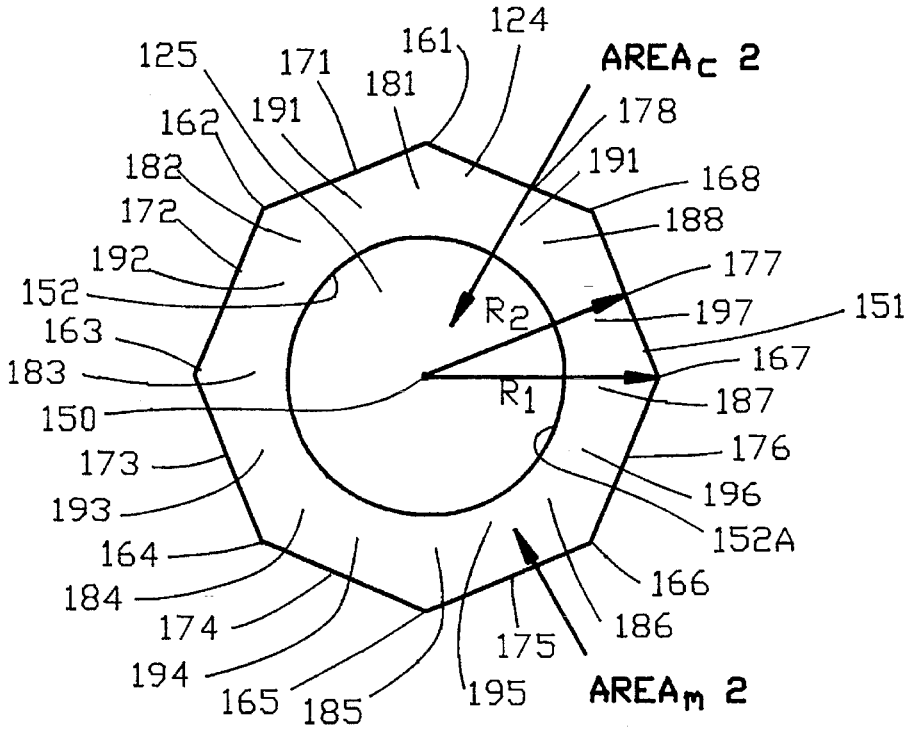
FIG. 13 is an enlarged view of FIG. 10.

FIG. 13 is an enlarged view of FIG. 10 illustrating the outer surface 151 being circumscribed about the central longitudinal tube axis 150. Each of the plurality of surface projections 161–168 have a radius of curvature $R_1$ about the central longitudinal tube axis 150. Each of the plurality of surface recesses 171–178 have a radius of curvature $R_2$ about the central longitudinal tube axis 150. The plurality of surface recesses 171–178 linearly extend between the plurality of surface projections 161–168.

Figure 14:
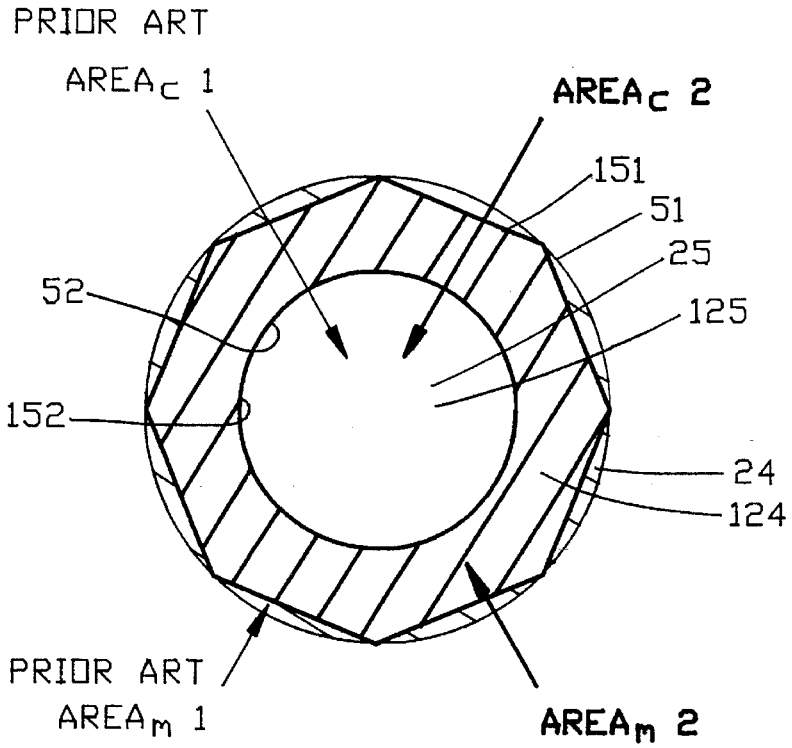
FIG. 14 is an enlarged view of FIG. 10 superimposed upon an enlarged view of FIG. 7.

FIG. 14 is an enlarged view of the improved dip tube 124 shown in FIG. 10 superimposed upon an enlarged view of the prior art dip tube 24 shown in FIG. 7. FIG. 14 illustrates the internal channel 125 of the improved dip tube 124 has substantially the same cross-sectional area ($AREA_c$ 2) as the cross-sectional area ($AREA_c$ 1) of the internal channel 25 of the prior art dip tube 24. However, the material cross-sectional area ($AREA_m$ 2) of the improved dip tube 124 is less than the material cross-sectional area ($AREA_m$ 1) of the prior art dip tube 24. Accordingly, the improved dip tube 124 requires a reduced the volume of material used in the construction of the improved dip tube 124 relative to the dip tube 24 of the prior art.

Table II illustrates the parameters of the improved dip tube 124 of the present invention for popular diameters of the internal channels 125.

TABLE II

| Improved Dip Tubes | | | | | | |
|---|---|---|---|---|---|---|
| Inside Diameter | First Diameter | Second Diameter | Major Wall | Minor Wall | Channel Area | Wall Area |
| 0.122 | 0.168 | 0.182 | 0.030 | 0.023 | 0.01169 | 001137 |
| 0.147 | 0.185 | 0.199 | 0.026 | 0.019 | 0.01697 | 001141 |
| 0.165 | 0.191 | 0.207 | 0.021 | 0.013 | 0.02151 | 000887 |
| 0.288 | 0.320 | 0.346 | 0.029 | 0.016 | 0.06514 | 001969 |

Table III illustrates a comparison of the material used in the construction of the improved dip tube 124 relative to the material used in the construction of the dip tube 24 of the prior art.

TABLE III

| Improved Dip Tube v Prior Art Dip Tube | | | | |
|---|---|---|---|---|
| Tube | Outside Diameter | Channel Area | Wall Area | Reduction Wall Area |
| Prior Art | 0.122 | 0.01169 | 0.01433 | |
| Prior Art | 0.147 | 0.01697 | 0.01320 | |
| Prior Art | 0.165 | 0.02151 | 0.01102 | |
| Prior Art | 0.288 | 0.06514 | 0.02459 | |
| Improved | 0.122 | 0.01169 | 0.01173 | 18% |
| Improved | 0.147 | 0.01697 | 0.01141 | 14% |
| Improved | 0.165 | 0.02151 | 0.00887 | 20% |
| Improved | 0.288 | 0.06514 | 0.01969 | 20% |

Table III illustrates that the improved dip tube 124 of the present invention provides anywhere from a 14% to 20% saving in material relative to the dip tube 24 of the prior art.

Presently, approximately 3 billion aerosols products are sold per year in the United States. Approximately seventy percent of these aerosol products use dip tubes of the present invention. Each of these aerosol products and pumps typically use a dip tube having a length of 7 inches per unit. The present invention is able to provide the dispensing industry with a substantial savings over the prior art.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A dip tube for a hand operated dispensing device comprising a dispenser affixed to a container with the dispenser having a dip tube receiver for frictionally securing the dip tube thereto with the dip tube extending into the fluid in proximity to a bottom of the container for directing the fluid from the container into the dispenser for dispensing the fluid from a terminal orifice, the improvement comprising:

said dip tube comprising a longitudinally extending tube defined about a central longitudinal tube axis;

said dip tube having an outer surface and an inner surface for defining a wall thickness therebetween;

said inner surface defining an internal channel having a predetermined cross-sectional area;

a plurality of surface projections protruding from said outer surface of said dip tube and extending longitudinally along said dip tube;

said plurality of surface projections being uniformly radially disposed about said dip tube for defining a plurality of recessed portions therebetween;

said plurality of surface projections defining major wall thickness portions proximate each of said plurality of surface projections for providing structural strength for said dip tube;

said plurality of recessed portions defining minor wall thickness portions proximate each of said plurality of recessed portions for reducing the volume of material used in the construction of the dip tube; and said dip tube being secured to the dip tube receiver of the dispenser for extending into the fluid within the container with said internal channel having said predetermined cross-sectional area with a reduced volume of material used in the construction of the dip tube.

2. A dip tube for a hand operated dispensing device as set forth in claim 1, wherein said plurality of surface projections protrude radially from said outer surface away from said central longitudinal tube axis.

3. A dip tube for a hand operated dispensing device as set forth in claim 1, wherein said dip tube defines a substantially cylindrical inner surface.

4. A dip tube for a hand operated dispensing device as set forth in claim 1, wherein said plurality of surface projections are uniformly radially interposed between said plurality of surface recessed portions.

5. A dip tube for a hand operated dispensing device as set forth in claim 1, wherein said plurality of surface projections are uniformly radially disposed about said central longitudinal tube axis of said dip tube.

6. A dip tube for a hand operated dispensing device as set forth in claim 1, wherein said plurality of surface projections comprise eight outer surface projections uniformly radially disposed about said central longitudinal tube axis of said dip tube.

7. A dip tube for a hand operated dispensing device as set forth in claim 1, wherein said plurality of surface projections comprise eight surface projections uniformly radially disposed about said central longitudinal tube axis of said dip tube; and said plurality of recessed portions comprising eight surface recesses uniformly radially disposed about said central longitudinal tube axis of said dip tube.

8. A dip tube for a hand operated dispensing device as set forth in claim 1, wherein said plurality of surface recessed portions define minor wall thickness portions between each of said plurality of surface recessed portions and said inner surface for reducing the volume of material used in the construction of the dip tube.

9. A dip tube for a hand operated dispensing device as set forth in claim 1, wherein said plurality of surface projections define major wall thickness portions between each of said plurality of surface projections and said inner surface;

said major wall thickness portions having a wall thickness commensurate with a wall thickness of a conventional dip tube for providing structural strength for said dip tube;

said plurality of surface recessed portions defining minor wall thickness portions between each of said plurality of surface recessed portions and said inner surface; and said minor wall thickness portions having a wall thickness less than a wall thickness of a conventional dip tube for reducing the volume of material used in the construction of the dip tube relative to a conventional dip tube.

10. A dip tube for a hand operated dispensing device comprising a dispenser affixed to a container with the dispenser having a dip tube receiver for frictionally securing the dip tube thereto with the dip tube extending into the fluid in proximity to a bottom of the container for directing the fluid from the container into the dispenser for dispensing the fluid from a terminal orifice, the improvement comprising:

said dip tube comprising a longitudinally extending tube defined about a central longitudinal tube axis;

said dip tube defining an outer surface and an inner surface;

said inner surface defining an internal channel having a predetermined cross-sectional area;

a plurality of surface projections protruding from said outer surface away from said central longitudinal tube axis and extending longitudinally along said dip tube;

said outer surface having a plurality of linear sectors defining a plurality of surface recessed portions;

said plurality of surface projections defining major wall thickness portions between each of said plurality of surface projections and said inner surface for providing structural strength for said dip tube; and said dip tube being secured to the dip tube receiver of the dispenser for extending into the fluid within the container to provide said internal channel with said predetermined cross-sectional area with a reduced volume of material used in the construction of the dip tube.

11. A dip tube for a hand operated dispensing device as set forth in claim 10, wherein said dip tube defines a substantially cylindrical inner surface.

12. A dip tube for a hand operated dispensing device as set forth in claim 10, wherein said plurality of surface projections are uniformly radially interposed between said plurality of surface recessed portions.

13. A dip tube for a hand operated dispensing device as set forth in claim 10, wherein said plurality of surface projections are uniformly radially disposed about said central longitudinal tube axis of said dip tube.

14. A dip tube for a hand operated dispensing device as set forth in claim 10, wherein said plurality of surface projections comprises eight surface projections uniformly radially disposed about said central longitudinal tube axis of said dip tube.

15. A dip tube for a hand operated dispensing device as set forth in claim 10, wherein said plurality of surface projections comprises eight projections uniformly radially disposed about said central longitudinal tube axis of said dip tube; and said plurality of surface recessed portions comprising eight surface recessed portions uniformly radially disposed about said central longitudinal tube axis of said dip tube and interposed between said plurality of surface projections.

16. A dip tube for a hand operated dispensing device as set forth in claim 10, wherein said major wall thickness portions has a wall thickness commensurate with a wall thickness of a conventional dip tube for providing structural strength for said dip tube;

said plurality of surface recessed portions defining minor wall thickness portions between each of said plurality of surface recessed portions and said inner surface; and said minor wall thickness portions having a wall thickness less than a wall thickness of a conventional dip tube for reducing the volume of material used in the construction of the dip tube relative to a conventional dip tube.

17. A dip tube for a hand operated dispensing device comprising a container and a dispenser affixed thereto for dispensing a fluid within the container through a terminal orifice, the dispenser having a dip tube receiver for frictionally securing the dip tube thereto, with the dip tube extending into the fluid in proximity to a bottom of the container for directing the fluid from the container into the dispenser for dispensing the fluid from a terminal orifice, the improvement comprising:

said dip tube comprising a longitudinally extending tube defined about a central longitudinal tube axis;

dip tube defining a substantially cylindrical inner surface;

dip tube defining an outer surface;

said inner surface defining an internal channel having a predetermined cross-sectional area;

a plurality of surface projections protruding from said outer surface away from said central longitudinal tube axis and extending longitudinally along said outer surface of said dip tube;

said outer surface having a plurality of linear sectors defining a plurality of surface recessed portions;

said plurality of surface projections being uniformly interposed between said plurality of surface recessed portions;

said plurality of surface projections defining major cylindrical wall thickness portions between each of said plurality of surface projections and said cylindrical inner surface for providing structural strength for said dip tube;

said plurality of surface recessed portions defining minor cylindrical wall thickness portions between each of said plurality of surface recessed portions and said cylindrical inner surface for reducing the volume of material used in the construction of the dip tube;

said inner surface of said dip tube being secured to the dip tube receiver of the dispenser for extending into the fluid within the container to provide said internal channel with said predetermined cross-sectional area with a reduced volume of material used in the construction of the dip tube.

* * * * *